US008613531B2

(12) United States Patent
Mochizuki

(10) Patent No.: US 8,613,531 B2
(45) Date of Patent: Dec. 24, 2013

(54) LIGHT EMITTING DEVICE

(75) Inventor: Keiichi Mochizuki, Nagano (JP)

(73) Assignees: Nittoh Kogaku K.K. (JP); Yashuhiro Koike (JP)

( * ) Notice: Subject to any disclaimer, the term of this patent is extended or adjusted under 35 U.S.C. 154(b) by 0 days.

(21) Appl. No.: 13/156,710

(22) Filed: Jun. 9, 2011

(65) Prior Publication Data

US 2011/0305026 A1 Dec. 15, 2011

(30) Foreign Application Priority Data

Jun. 14, 2010 (JP) ..... 2010-134800

(51) Int. Cl.
*F21V 7/00* (2006.01)

(52) U.S. Cl.
USPC ..... 362/308; 313/113

(58) Field of Classification Search
USPC ..... 313/113; 362/308, 309
See application file for complete search history.

(56) References Cited

U.S. PATENT DOCUMENTS

2005/0225988 A1* 10/2005 Chaves et al. ..... 362/332
2006/0119250 A1* 6/2006 Suehiro et al. ..... 313/498
2008/0297020 A1* 12/2008 Wanninger et al. ..... 313/110
2009/0180286 A1* 7/2009 Bamba et al. ..... 362/297
2010/0026157 A1 2/2010 Tanaka et al.
2010/0109500 A1* 5/2010 Kao et al. ..... 313/46
2010/0220485 A1* 9/2010 Kim et al. ..... 362/309

FOREIGN PATENT DOCUMENTS

JP 2010-33959 A 2/2010

* cited by examiner

*Primary Examiner* — Anh Mai
*Assistant Examiner* — Andrew Coughlin
(74) *Attorney, Agent, or Firm* — Cantor Colburn LLP

(57) ABSTRACT

To provide a light emitting device that realizes a similar light distribution state to that of a conventional incandescent light bulb even though the light emitting device has a structure with a light emitting element such as an LED placed on a substrate. In the light emitting device in which the LED is placed on the substrate, the light emitting device includes the light guiding member, into which light emitted from the LED enters, while the light guiding member having the launching surface (i.e., the facing-substrate launching surface and the side launching surface) from which the entered light is launched. Meanwhile, the launching surface has the facing-substrate launching surface including a total reflection surface for totally reflecting light incident in the launching surface at a critical angle, in a direction tilted toward a side of the substrate than a direction perpendicular to the optical axis of the light emitting device. Furthermore, the launching surface also has the side launching surface including a refractive surface for refracting and launching light, totally reflected by the facing-substrate launching surface, in a direction toward the side of the substrate.

3 Claims, 5 Drawing Sheets

LIGHT EMITTING DEVICE

CROSS-REFERENCE TO RELATED APPLICATION

The present application is related to, claims priority from and incorporates by reference Japanese patent application number 2010-134800, filed on Jun. 14, 2010.

BACKGROUND OF THE INVENTION

1. Field of the Invention

The present invention relates to a light emitting device.

2. Description of Related Art

A light emitting device described in the prior art document mentioned below is proposed as a light emitting device using LEDs (Light Emitting Diodes) for its light source. The light emitting device is a compact LED lamp in which a reduction in light distribution uniformity is suppressed. In the compact LED lamp, a plurality of LEDs are laid out at an outer edge side of a center position on a principal surface of an LED substrate main body, being individually displaced.

Patent Document 1: JP2010-033959

SUMMARY OF THE INVENTION

In the compact LED lamp described in Patent Document 1, since the LEDs are laid out on the principal surface of the LED substrate main body, light is hardly radiated toward a side opposite to the principal surface of the LED substrate main body. Therefore, the compact LED lamp can barely realize such a light distribution state, in which light is radially radiated from a light emitting part, as a conventional incandescent light bulb does. Then, in some cases, the compact LED lamp may not be a perfect alternative to a conventional incandescent light bulb. For example, in the case of a compact LED lamp positioned away from a ceiling for a certain distance, the lamp does not illuminate an area between the lamp and the ceiling so that an area in the vicinity of the ceiling becomes darkish.

Thus, it is an object of the present invention to provide a light emitting device that realizes a similar light distribution state to that of a conventional incandescent light bulb even though the light emitting device is a compact LED lamp including a light emitting element such as an LED laid out on a substrate.

To achieve the object described above, a light emitting device according to the present invention includes: a substrate; a light emitting element placed on the substrate; and a light guiding member, into which light emitted from the light emitting element enters, the light guiding member having a launching surface from which the entered light is launched; wherein the launching surface has a total reflection surface for totally reflecting light incident on the launching surface at a critical angle, in a direction tilted toward a side of the substrate than a direction perpendicular to an optical axis of the light emitting device; and the launching surface also has a refractive surface for refracting and launching light, totally reflected by the total reflection surface, in a direction toward the side of the substrate.

It is preferable that the launching surface includes a curved surface, and a center of curvature for the curved surface is located at a position opposite to the light emitting element across the launching surface.

It is preferable that the substrate, on which the light emitting element is placed, includes a plug that is connected to a socket at a power supply side.

According to the present invention, provided can be a light emitting device that realizes a similar light distribution state to that of a conventional incandescent light bulb even though the light emitting device has a structure with a light emitting element such as an LED laid out on a substrate.

BRIEF DESCRIPTION OF THE DRAWINGS

Specific embodiments of the present invention will now be described, by way of example only, with reference to the accompanying drawings in which.

DETAILED DESCRIPTION OF THE PREFERRED EMBODIMENTS

Structures and functions of a light emitting device according to embodiments of the present invention are described below with reference to the accompanied drawings.

(Structure of Light Emitting Device)

Figure 1:
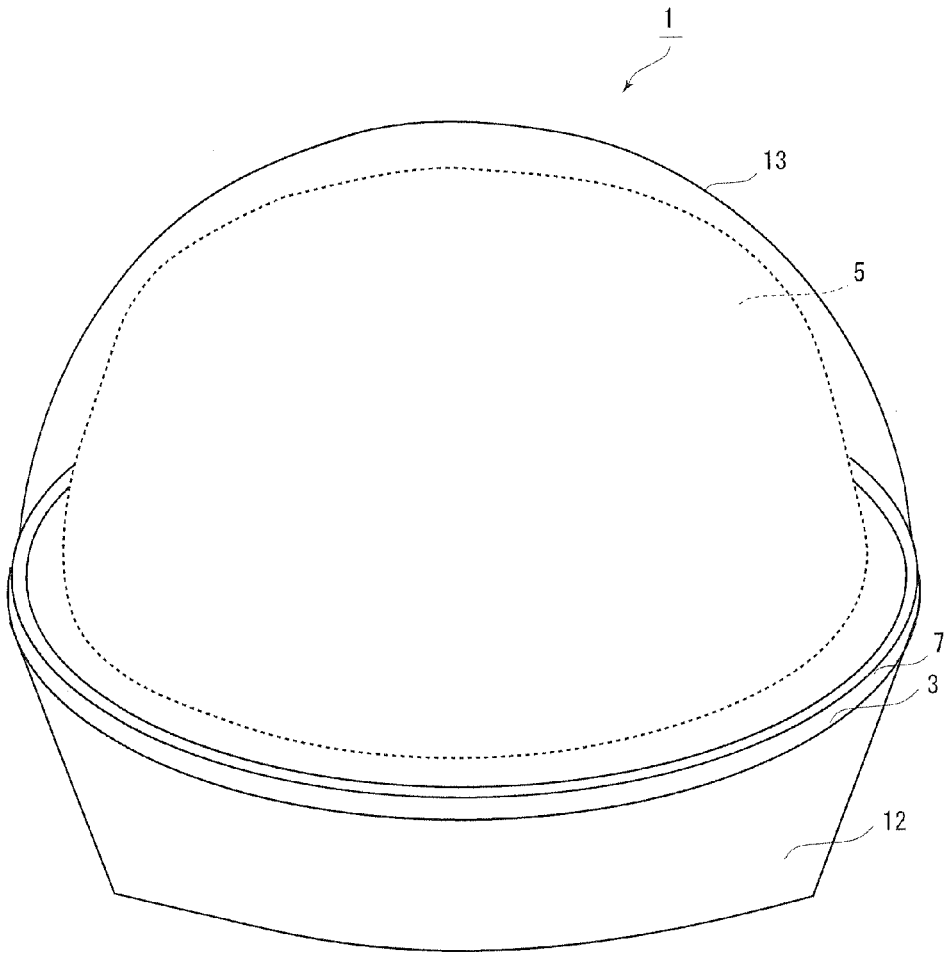
FIG. 1 is a perspective view showing a structure of a light emitting device according to an embodiment of the present invention.
Figure 2:
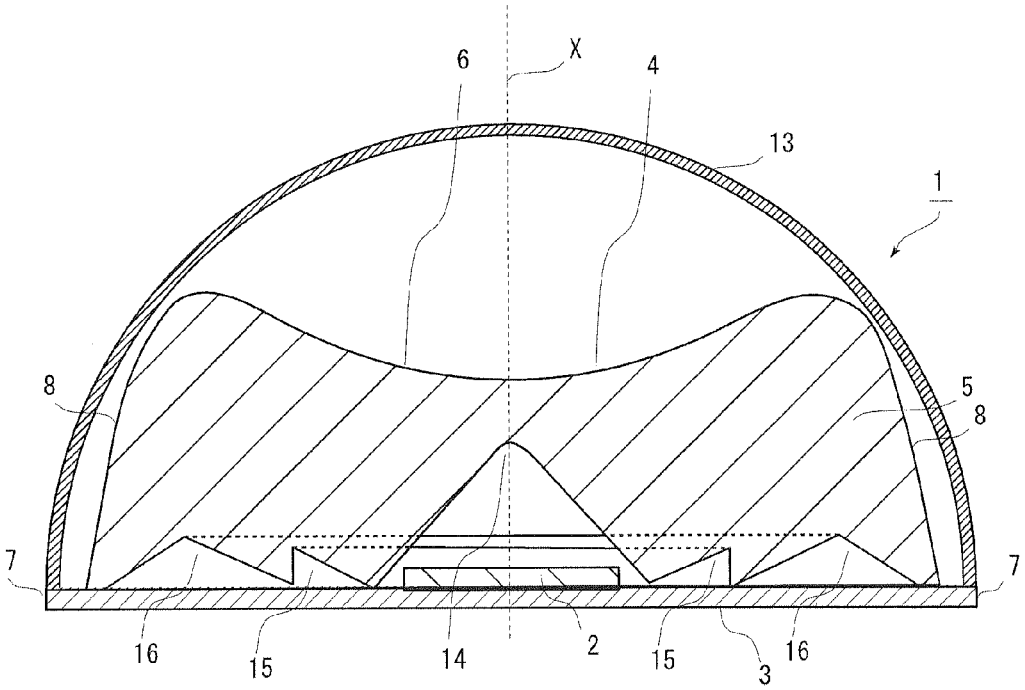
FIG. 2 is a longitudinal sectional view of the light emitting device shown in FIG. 1, wherein a plug is omitted.

FIG. 1 is a perspective view showing a structure of a light emitting device 1 according to an embodiment of the present invention. FIG. 2 is a longitudinal sectional view of the light emitting device 1 shown in FIG. 1, wherein a plug 12, to be described later, is omitted.

The light emitting device 1 is a bulb-shaped light emitting device including a chip LED 2 as a light emitting element and a light guiding member 5 on a substrate 3. Light emitted from the LED 2 enters the light guiding member 5, and then they are launched from a launching surface 4. The launching surface 4 includes a facing-substrate launching surface 6 that faces the substrate 3, and a side launching surface 8 positioned at a side of an edge part 7 of the substrate 3. The facing-substrate launching surface 6 is curved around on a center of curvature located at a position opposite to the LED 2 across the launching surface 4. The side launching surface 8 is a slope that is so tilted as to become closer to an optical axis X as a slope location becomes further away from the substrate 3. Moreover, the side launching surface 8 has a curved form that swells out in a direction departing from the optical axis X. The facing-substrate launching surface 6 includes a total reflection surface that can totally reflect light incident on the facing-substrate launching surface 6 at a critical angle, in a direction tilted toward a side of the substrate 3 than a direction perpendicular to the optical axis X of the light emitting device 1. Furthermore, the side launching surface 8 includes a refractive surface that can refract and launch light totally reflected by the facing-substrate launching surface 6, toward a side of the substrate 3.

The substrate 3 included in the light emitting device 1 is connected to the plug 12. In the meantime, the plug 12 includes an electric power supply function (not illustrated) for supplying the LED 2 with electricity for making the LED 2 emit light. Then, a hemispherical transparent cover 13 is placed outside the light guiding member 5. The facing-substrate launching surface 6 as well as the side launching surface 8 of the light guiding member 5 are covered with the cover 13 being dome-shaped.

In the light guiding member 5, a light incoming section 14 is formed at a surface opposite to the facing-substrate launching surface 6. The light incoming section 14 is a conically-shaped cutout part, where light emitted from the LED 2 enters. A central axis of the conical part of the light incoming section 14 is concentric with the optical axis X of the light emitting device 1. Furthermore, in the light guiding member 5, a first circular groove 15 and a second circular groove 16 are formed in due order, in a direction departing from the optical axis X, at the surface opposite to the facing-substrate launching surface 6. The first circular groove 15 and the second circular groove 16 are so formed as to be circular around the optical axis X. Each of the first circular groove 15 and the second circular groove 16 is so shaped as to become indented in a direction from a side of the substrate 3 to a side of the facing-substrate launching surface 6, having a triangular cross-section.

The light guiding member 5 is a transparent poly-methyl methacrylate (hereinafter abbreviated to "PMMA") resin compact. Then, the light guiding member 5 contains silicone particles. Described next are the silicone particles contained in the light guiding member 5. The silicone particles are light guiding elements provided with a uniform scattering power within their volume-wise extent, and they include a number of spherical particles as scattering fine particles. When light enters an internal area of the light guiding member 5, the light is scattered by the scattering fine particles.

The Mie scattering theory that provides the theoretical fundamentals of the silicone particles is explained next. Calculated in the Mie scattering theory is a solution for Maxwell's equations of electromagnetism in the case where spherical particles (scattering fine particles) exist in a ground substance (matrix) having a uniform refractive index, wherein the spherical particles having a refractive index that is different from the refractive index of the matrix. A formula (1) described below expresses a light intensity distribution I (A, Θ) dependent on the angle of light scattered by scattering fine particles that correspond to light scattering particles. "A" is a size parameter representing an optical size of the scattering fine particles, and the parameter shows an amount corresponding to a radius "r" of the spherical particles (the scattering fine particles) standardized with a wavelength "λ" of light in the matrix. Meanwhile, an angle "Θ" represents a scattering angle, wherein a direction identical to a traveling direction of an incoming light corresponds to "Θ=180 deg."

"i1" and "i2" in the formula (1) are expressed with formulas (4). Then, "a" and "b" subscripted with "v" in formulas (2) to (4) are expressed with formulas (5). P(COS Θ) superscripted with "1" and subscripted with "v" is a Legendre polynomial; meanwhile "a" and "b" subscripted with "v are composed of a first kind Recatti—Bessel function $\Psi_v$, a second kind Recatti—Bessel function $\zeta_v$, and their derivatives. "m" is a relative refractive index of the scattering fine particles with reference to the matrix, namely "m=n-scatter/n-matrix."

$$I(A, \Theta) = \frac{\lambda^2}{8\pi^2}(i_1 + i_2) \tag{1}$$

$$K(A) = \left(\frac{2}{\alpha^2}\right)\sum_{v=1}^{\infty}(2v+1)(|a_v|^2 + |b_v|^2) \tag{2}$$

$$A = 2\pi r/\lambda \tag{3}$$

$$i_1 = \left|\sum_{v=1}^{\infty}\frac{2v+1}{v(v+1)}\left\{a_v\frac{P_v^1(\cos\Theta)}{\sin\Theta} + b_v\frac{dP_v^1(\cos\Theta)}{d\Theta}\right\}\right| \tag{4}$$

$$i_2 = \left|\sum_{v=1}^{\infty}\frac{2v+1}{v(v+1)}\left\{b_v\frac{P_v^1(\cos\Theta)}{\sin\Theta} + a_v\frac{dP_v^1(\cos\Theta)}{d\Theta}\right\}\right|$$

$$a_v = \frac{\Psi_v'(mA)\Psi_v(A) - m\Psi_v(mA)\Psi_v'(A)}{\Psi_v'(mA)\zeta_v(A) - m\Psi_v(mA)\zeta_v'(A)} \tag{5}$$

$$b_v = \frac{m\Psi_v'(mA)\Psi_v(A) - \Psi_v(mA)\Psi_v'(A)}{m\Psi_v'(mA)\zeta_v(A) - \Psi_v(mA)\zeta_v'(A)}$$

Figure 3:
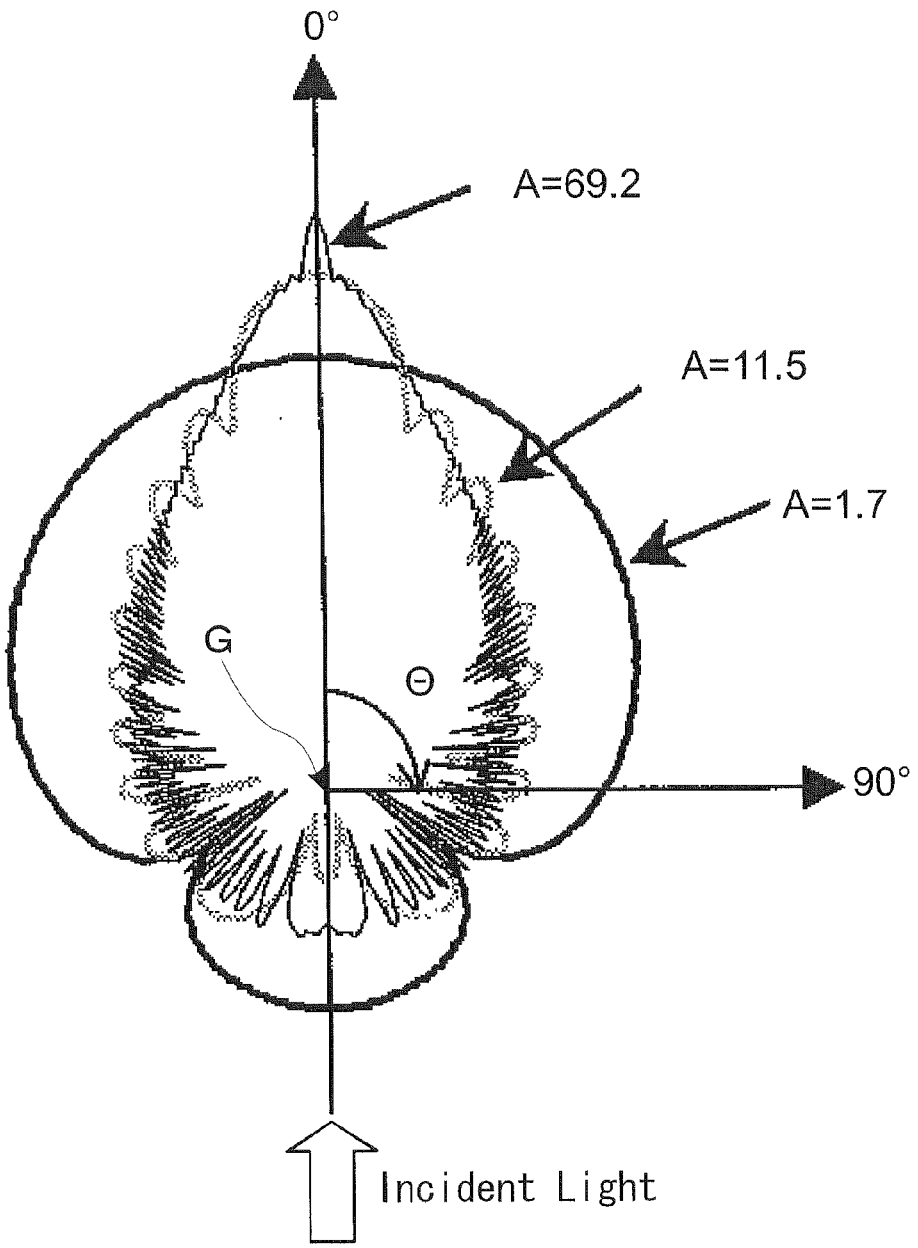
FIG. 3 is a drawing to show a theory of scattering by silicon particles as light scattering particles in a light guiding member shown in FIG. 1 and FIG. 2, and the drawing is a graph showing an angle distribution (A, (j) of a scattered light intensity by a single spherical particle.

FIG. 3 is a graph showing a light intensity distribution I (A, Θ) by a single spherical particle on the basis of the above formulas (1) to (5). Namely, FIG. 3 shows an angular distribution of scattered light intensity I (A, Θ) in the case of light coming in from a lower side, wherein a spherical particle as a scattering fine particle exists at a position of an origin "G". In the figure, a distance from the origin "G" to each curve represents the scattered light intensity in a corresponding angular direction of the scattered light. The curves show the scattered light intensity when the size parameter "A" is 1.7, 11.5, and 69.2, respectively. In FIG. 3, the scattered light intensity is expressed in a logarithmic scale. Therefore, even a slight difference of intensity that appears in FIG. 3 is a significantly large difference in fact.

As shown FIG. 3, it is understood that; the greater the size parameter "A" is (the larger the spherical particle diameter is, at a certain wavelength "λ"), the more intensively the light is scattered in an upward direction (a frontward direction in the direction of radiation) with a directivity. In reality, the angular distribution of scattered light intensity I (A, Θ) can be controlled by using the radius "r" of the scattering element and the relative refractive index "m" between the matrix and the scattering fine particles as parameters, while the wavelength "λ" of the incoming light is set to be constant. Incidentally, the light guiding member 5 is provided with a greater scattering capability in a forward direction.

Thus, when light enters a light scattering and guiding element that contains N (in number) single spherical particles, the light is scattered by a spherical particle. Moving forward through the light scattering and guiding element, the scattered light is then scattered again by another spherical particle. In the case where particles are added with a certain volume concentration or higher, such scattering operation sequentially repeats several times and then the light is launched out of the light scattering and guiding element. A phenomenon, in which such scattered light is further scattered, is called a multiple scatter phenomenon. Though it is not easy to analyze such a phenomenon of multiple scattering in a translucent polymer substance by means of a ray tracing method, the behavior of light can be traced by a Monte Carlo method for analysis of its characteristics. According to the analysis, in the case of incident light being unpolarized, a cumulative distribution function of scattering angle "F(Θ)" is expressed with a formula (6) described next.

$$F(\Theta) = \frac{\int_0^{\Theta} I(\Theta)\sin\Theta\, d\Theta}{\int_0^{\pi} I(\Theta)\sin\Theta\, d\Theta} \tag{6}$$

"I(Θ)" in the formula (6) means the scattered light intensity of the spherical particle of the size parameter "A" expressed in the formula (1). When light having an intensity "I0" enters the light scattering and guiding element, and transmits for a distance "y" so as to be attenuated into "I" through the scattering, a formula (7) described below represents a relationship of the phenomenon.

$$\frac{I}{I_0} = \exp(-\tau y) \tag{7}$$

"τ" in the formula (7) is called the turbidity; and it corresponds to a scattering coefficient of the matrix, and being proportional to the number of particles "N", as a formula (8) indicates below. In the formula (8), "σs" represents a scattering cross-section area.

$$\tau = \sigma^s N \tag{8}$$

According to the formula (7), the probability "$p_t(L)$" of transmission passing through the light scattering and guiding element having its length "L" without any scattering is expressed by a formula (9) described below.

$$p_t(L) = \frac{I}{I_0} = \exp(-\sigma^s NL) \tag{9}$$

On the contrary, the probability "$p_s(L)$" of having any scattering within the optical path length "L" is expressed by a formula (10) described below.

$$p_s(L) = 1 - p_t(L) = 1 - \exp(-\sigma^s NL) \tag{10}$$

It is understood according to the formulas described above that adjusting the turbidity "τ" makes it possible to control a degree of multiple scattering in the light scattering and guiding element.

As the formulas indicate above, by using at least one of the size parameter "A" and the turbidity "τ" with respect to the scattering fine particles as a parameter, it becomes possible to control multiple scattering in the light scattering and guiding element, and also to suitably set the launching light intensity and the scattering angle at a launching surface 4.

Light scattering particles contained in the light guiding member 5 are translucent silicone particles having their average particle diameter of 2.4 microns. Meanwhile, the turbidity "τ", which is a scattering parameter corresponding to the scattering coefficient of light scattering particles, is given as τ=0.49 (λ=550 nm).

(Light Paths in the Light Emitting Device 1)

Figure 4:
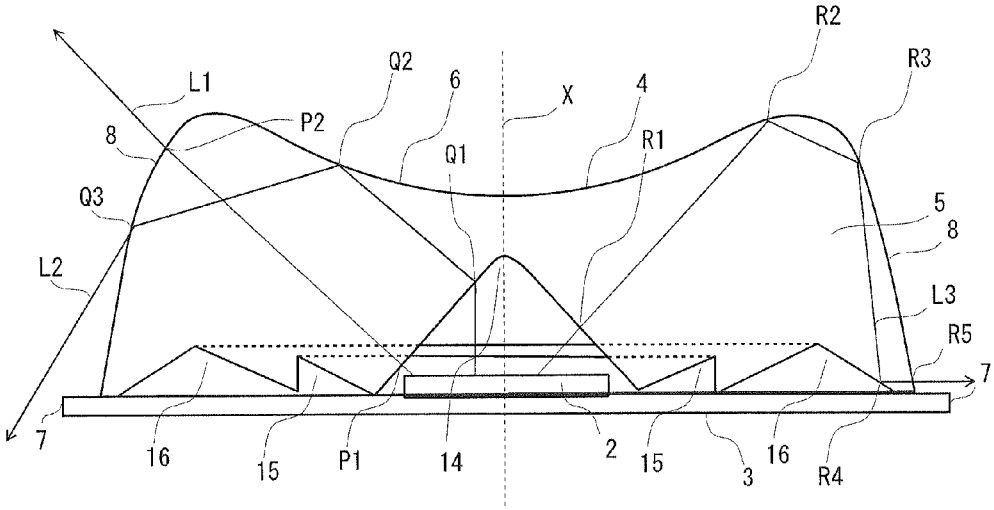
FIG. 4 is a drawing that additionally includes light paths in the longitudinal sectional view of the light emitting device shown in FIG. 2; and hatching provided for the light guiding member shown in FIG. 2 is omitted and a cover as well as the plug are also omitted in FIG. 4.

FIG. 4 shows traveling paths of rays of light L1 through L3 among rays of light emitted from the LED 2. In FIG. 4, hatching provided for the light guiding member 5 shown in FIG. 2 is omitted, and a cover 10 as well as the plug 12 are also omitted. Being emitted from the LED 2, the ray of light L1 enters the light guiding member 5 through a position P1 of the light incoming section 14, and then it is launched through a position P2 of the side launching surface 8. In this step, since the ray of light L1 enters a surface of the light incoming section 14 almost perpendicularly at the position P1 of the light incoming section 14, almost no refraction happens. Then, at the position P2 of the side launching surface 8 in FIG. 4, since the ray of light L1 entered is radiated at an angle less than a critical angle for total reflection, the light is launched from the side launching surface 8 with no total reflection.

Being emitted from the LED 2 almost perpendicularly in FIG. 4, the ray of light L2 enters the light guiding member 5 through a position Q1 of the light incoming section 14, then the light is totally reflected at a position Q2 of the facing-substrate launching surface 6, and furthermore it is refracted and launched downward in FIG. 4 (toward a side of the substrate 3) at a position Q3 of the side launching surface 8. At the position Q1 of the light incoming section 14, the ray of light L2 enters a surface of the light incoming section 14 at about 45 degrees; and then at the position Q2, the ray of light L2 is radiated to the facing-substrate launching surface 6 at an angle greater than the critical angle so that a total reflection happens there. Furthermore, at the position Q3 of the side launching surface 8, the ray of light L2 enters the side launching surface 8 at an angle less than the critical angle so as to pass through (being emitted from) the side launching surface 8. At the time, the ray of light L2 is refracted downward in FIG. 4. Namely, at the position Q3, the ray of light L2 is more refracted toward the side of the substrate 3 than a light path supposed on the assumption that no refraction happens at the side launching surface 8 as a refractive surface.

Being emitted from the LED 2, the ray of light L3 enters the light guiding member 5 through a position R1 of the light incoming section 14, and the ray of light L3 is totally reflected at a position R2 of the facing-substrate launching surface 6, and then it is totally reflected at a position R3 of the side launching surface 8. Moreover, the ray of light L3 is totally reflected again at a position R4 of a surface of the second circular groove 16, and launched along the substrate 3 through a position R5 of the side launching surface 8. At the position R1 of the light incoming section 14, the ray of light L3 enters a surface of the light incoming section 14 almost perpendicularly. Furthermore, the ray of light L3 enters each of the position R2 of the facing-substrate launching surface 6, the position R3 of the side launching surface 8, and the position R4 of the surface of the second circular groove 16 shown in FIG. 4 at each angle greater than the critical angle so that a total reflection happens there. Afterward, at the position R5 of the side launching surface 8, the light enters the side launching surface 8 at an angle less than the critical angle so as to pass through (being emitted from) there with no total reflection. At the position R5, the ray of light L3 is refracted toward the side of the substrate 3 and launched from there.

As the ray of light L1 described above is, most of the light emitted from the LED 2 and launched from the light guiding member 5 with no total reflection at the launching surface 4 are launched from the light guiding member 5 toward a side that becomes further away from the substrate 3. In the meantime, if the facing-substrate launching surface 6 and the side launching surface 8 are formed suitably, light can be launched from the light guiding member 5 while being refracted toward the side of the substrate 3, as the rays of light L2 and L3 described above are. In other words, a light distribution state of the light launched from the light guiding member 5 can be changed, depending on incident angles of the light entering the facing-substrate launching surface 6 and the side launching surface 8. With respect to the amount of light refracted toward the side of the substrate 3 and launched from the light guiding member 5, as well as the amount of light launched in a direction that becomes further away from the substrate 3, those amounts of light can be adjusted as required by suitably forming shapes of the facing-substrate launching surface 6 and the side launching surface 8.

(Advantageous Effect Achieved by the Embodiment of the Present Invention)

The light emitting device 1 radiates light downward in FIG. 4 (toward the side of the substrate 3), as the ray of light L2 shown in FIG. 4. Furthermore, the light emitting device 1 totally reflects light, such as the ray of light L3, at a surface of the second circular groove 16, and therefore launches the light out of the side launching surface 8 without entering the light into the substrate 3. Accordingly, even with a structure including the LED 2 placed on the substrate 3, the light emitting device 1 can radiate light in a direction from the substrate 3 toward the plug 12 in order to realize a similar light distribution state to that of a conventional incandescent light bulb.

Formed in the launching surface 4 of the light guiding member 5 is the facing-substrate launching surface 6 including a curved surface, wherein a center of curvature for the curved surface is located at a position opposite to the light emitting element across the launching surface. Therefore, an incident angle of light emitted from the LED 2 into the facing-substrate launching surface 6 can be made to be great so that a total reflection happens easily.

The substrate 3, on which the LED 2 is placed, is mounted on the plug 12, and therefore the light guiding member 5 can function as a light bulb. Accordingly, the light emitting device 1 can realize a similar light distribution state to that of a conventional incandescent light bulb.

Furthermore, the light guiding member 5 contains light scattering particles in order to multiply-scatter light in the light guiding member 5 for increasing the amount of light that illuminates a side of the plug 12 from the substrate 3.

(Other Embodiments)

The light emitting device 1 according to the embodiment of the present invention described above is just an example of a preferred embodiment, but not limited to that of the embodiment. Various other variations may be made without departing from the concept of the present invention.

In the light emitting device 1 in which the LED 2 is placed on the substrate 3, the light emitting device 1 includes the light guiding member 5, into which light emitted from the LED 2 enters, while the light guiding member 5 having the launching surface 4 (i.e., the facing-substrate launching surface 6 and the side launching surface 8) from which the entered light is launched; wherein the launching surface 4 has the facing-substrate launching surface 6 including a total reflection surface for totally reflecting light incident on the launching surface 4 at a critical angle, in a direction tilted toward a side of the substrate 3 than a direction perpendicular to the optical axis X of the light emitting device 1. Furthermore, the launching surface 4 also has the side launching surface 8 including a refractive surface for refracting and launching light, totally reflected by the facing-substrate launching surface 6, in a direction toward the side of the substrate 3.

In the embodiment, a chip LED is used as the LED 2. Alternatively, a discreet LED may be used instead. Moreover, not being limited to the LED 2, the light emitting element may be materialized with an organic electro-luminescence (OEL) element, and the like.

Figure 5:
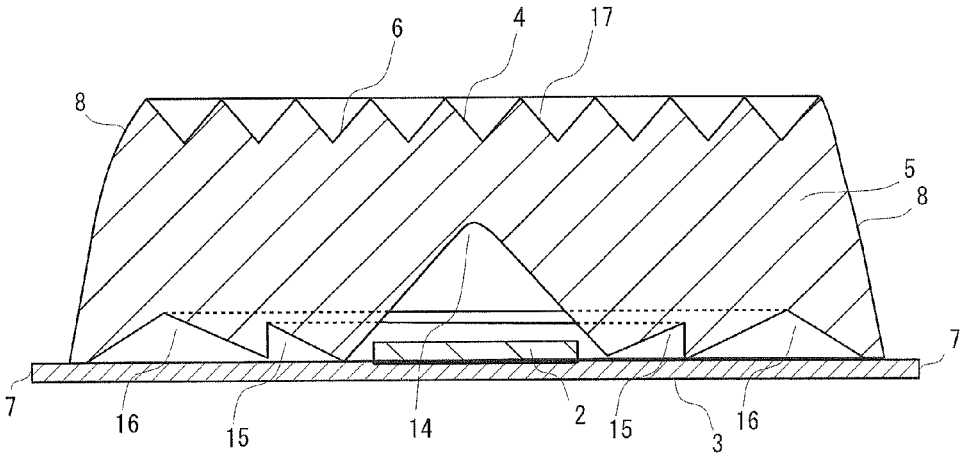
FIG. 5 is a longitudinal sectional view showing a structure of a modification of the light emitting device according to the embodiment of the present invention, wherein a cover as well as a plug are omitted.
Figure 6:
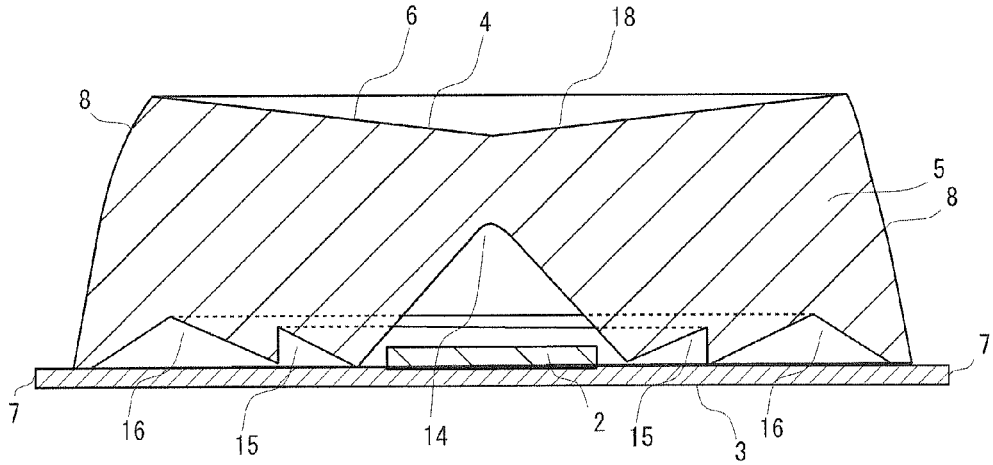
FIG. 6 is a longitudinal sectional view showing a structure of another modification of the light emitting device according to the embodiment of the present invention, wherein a cover as well as a plug are omitted.

Formed in the launching surface 4 of the light guiding member 5 is the facing-substrate launching surface 6 including a curved surface, wherein a center of curvature for the curved surface is located at a position opposite to the light emitting element across the launching surface. Alternatively, not being necessarily formed as a curved surface, the facing-substrate launching surface 6 may be structured with a surface form in which circular grooves 17 are placed concentrically wherein each of the grooves is so shaped as to become indented with a triangular cross-section as shown in FIG. 5. Furthermore, the launching surface may be structured as well with an indented form surface 18 instead, wherein the surface is indented to be conical as shown in FIG. 6.

The substrate 3, on which the LED 2 is placed, includes the plug 12 that is connected to a socket at a power supply side. Therefore, the light emitting device 1 can be used in the same way as a light bulb is. Alternatively, the light emitting device 1 may not be equipped with the plug 12.

The light guiding member 5 contains light scattering particles. The light scattering particles are not an indispensable element, and therefore alternatively, the light guiding member 5 may not contain the light scattering particles.

Used as the light guiding member 5 is a component made of PMMA. Alternatively, for the member, it is also possible to use any other translucent resin material such as acrylic resin material, polystyrene, polycarbonate, and the like that are other kinds of polymer materials of acrylic acid ester, or methacrylate ester, and are amorphous synthetic resin materials having high transparency, as well as glass material and so on.

REFERENCE EXAMPLE

Figure 7:
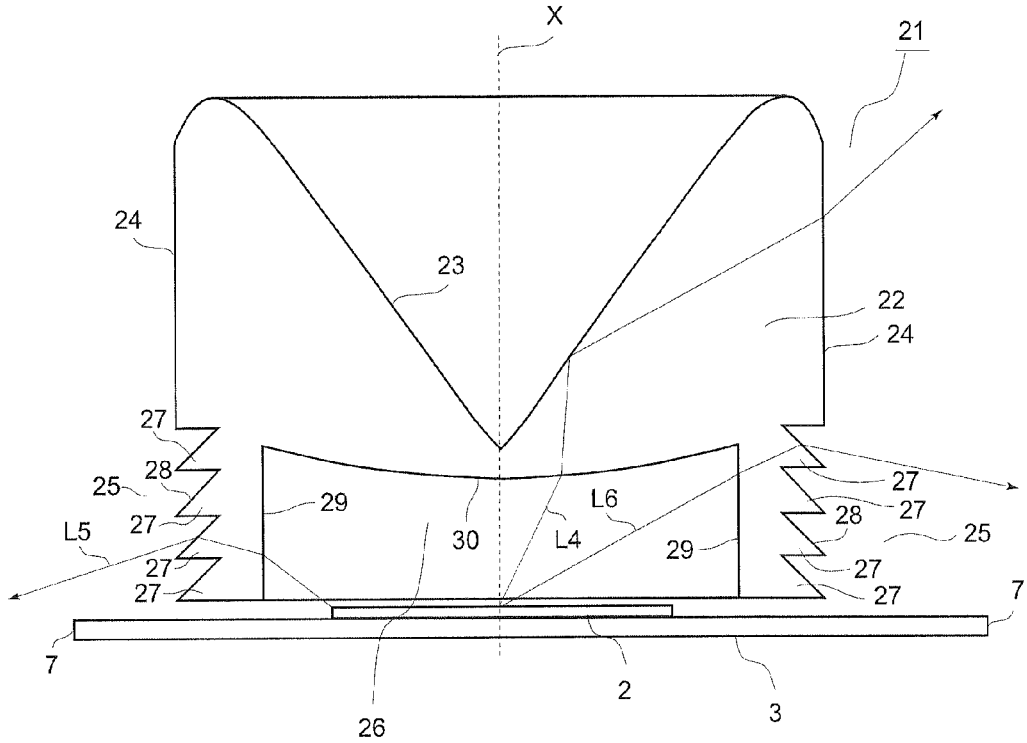
FIG. 7 is a drawing to show a structure of an example of a light emitting device.

A structure of a light emitting device 21 shown in FIG. 7 also enables light radiation in a direction from the substrate 3 toward a side of the plug 12. FIG. 7 shows light paths in the light emitting device 21 in the same way as FIG. 4 does. In FIG. 7, each of the same or equivalent components as its corresponding one existing in the light emitting device 1 according to the embodiment of the present invention is provided with the same reference numeral that the corresponding one has, and an explanation on the component is omitted. A light guiding member 22 of the light emitting device 21 includes a facing-substrate launching surface 23, a first side launching surface 24, a second side launching surface 25, and a light incoming section 26.

The facing-substrate launching surface 23 is so formed as to have an almost-conical indent part around an optical axis X, being provided with a form in which the further an elevation is from the LED 2, the greater an opening diameter at the elevation is. The first side launching surface 24 is so formed as to have a cylindrical surface around the optical axis X. Meanwhile, the second side launching surface 25 is so formed as to have a plurality of protrusion parts 27 placed along the optical axis X. The protrusion parts 27 are placed circularly around the optical axis X. Each of the protrusion parts 27 has a triangular cross-section on a surface along the optical axis X, while being provided with a slope 28 tilted with respect to the optical axis X. The slope 28 is tilted, in a direction from the optical axis X toward an edge part 7 of the substrate 3, to a side of the substrate 3. The light incoming section 26 includes a cylindrical sidewall surface 29 and a convex lens surface 30 that is so formed as to be convex toward the LED 2.

Described next is an explanation on light paths of rays of light L4, L5, and L6 emitted from the LED 2. The ray of light L4 emitted from the LED 2 to enter the convex lens surface 30 is refracted toward the optical axis X, then totally reflected by the facing-substrate launching surface 23, and launched from the first side launching surface 24. When being launched from the first side launching surface 24, the ray of light L4 is refracted to a forward direction (an opposite direction from the substrate 3) and then launched. Light emitted from the LED 2 to enter the convex lens surface 30 is divided into two rays of light, one of which is totally reflected by the facing-substrate launching surface 23 and launched from the first side launching surface 24, and the other of which is launched from the facing-substrate launching surface 23. Therefore, by properly adjusting incident angle of light emitted from the LED 2 at the time when the light enters the convex lens surface 30 and the facing-substrate launching surface 23, a light distribution state of the light emitting device 21 in a frontward direction (an opposite direction from a placement position of the substrate 3) can be set as required.

The rays of light L5 and L6 emitted from the LED 2 to enter the sidewall surface 29 are refracted to a side of the substrate 3 at the sidewall surface 29, and they are also refracted to the side of the substrate 3 when being launched from the slope 28. In other words, since the rays of light are refracted twice both at the sidewall surface 29 and the slope 28 to the side of the substrate 3, the rays of light are able to illuminate the side of the substrate 3 efficiently. By properly adjusting incident angle of light emitted from the LED 2 at the time when the light enters the sidewall surface 29 and the slope 28, a light distribution state of the light emitting device 21 in a rearward direction (a direction toward the substrate 3) can be set as required.

Thus, the light emitting device 21 launches light, not only in a direction departing from the substrate 3, like the ray of light L4; but also to the side of the substrate 3, like the rays of light L5 and L6. Therefore, the light emitting device 21 can realize a similar light distribution state to that of a conventional incandescent light bulb, in the same way as the light emitting device 1 according to the embodiment of the present invention.

What is claimed is:

1. A light emitting device comprising:

a substrate;

a light emitting element provided on the substrate; and a light guiding member comprising:

a light incoming surface where light emitted from the light emitting element enters;

a launching surface from which light entering the light guiding member through the light incoming surface is launched;

wherein the light guiding member is configured such that a portion of the light emitted by the light emitting element is reflected or refracted so as to illuminate an area on a side of the substrate opposite to the light emitting element;

the launching surface comprises a curved surface and a side launching surface;

a center of curvature of the curved surface is provided at a position opposite to the light emitting element;

the curved surface is configured such that a portion of the light emitted by the light emitting member, entering the light guiding member through the light incoming surface, and reaching the curved surface without otherwise being refracted or reflected, is totally reflected by the curved surface;

the curved surface is configured such that light emitted from the light emitting element and totally reflected by the curved surface is directed toward the side launching surface;

the side launching surface is configured as a slope that is tilted so as to become closer to an optical axis of the light emitting device as a slope location becomes further away from the substrate and has a curved form that swells out in a direction departing from the optical axis, such that light totally reflected by the curved surface and incident on the side launching surface is refracted in a direction toward a plane defined by a surface of the substrate, such that an angle between the refracted light and an optical axis of the light emitting device is less than an angle between the refracted light and a direction perpendicular to the optical axis of the light emitting device; and a circular groove is formed in the light guiding member at the surface opposite to the curved surface around the optical axis of the light emitting device such that light totally reflected by the curved surface and further totally reflected by the side launching surface is reflected toward the side launching surface and launched through the side launching surface.

2. The light emitting device according to claim 1:

wherein the substrate, on which the light emitting element is placed, includes a plug that is connected to a socket at a power supply side.

3. The light emitting device according to claim 1, wherein the light guiding member comprises a light incoming section that is an approximately conically shaped cutout part having a central axis that coincides with an optical axis of the light emitting device; and the light incoming section is provided over the light emitting element and configured such that light emitted by the light emitting element enters the light guiding member through the light incoming section.

* * * * *